United States Patent [19]

Dubost et al.

[11] 4,200,476

[45] Apr. 29, 1980

[54] PROCESS FOR THE THERMAL TREATMENT OF THICK PRODUCTS MADE OF COPPER-CONTAINING ALUMINUM ALLOYS OF THE 7000 SERIES

[75] Inventors: Bruno Dubost; Jean Bouvaist, both of Grenoble, France

[73] Assignee: Societe de Vente de l'Aluminium Pechiney, Paris, France

[21] Appl. No.: 961,861

[22] Filed: Nov. 20, 1978

[30] Foreign Application Priority Data

Nov. 21, 1977 [FR] France ..... 77 35673

[51] Int. Cl.[2] ..... C22F 1/04

[52] U.S. Cl. ..... 148/12.7 A; 148/13.1; 148/32.5; 148/159

[58] Field of Search ..... 148/159, 12.7 A, 13.1, 148/32.5

[56] References Cited

FOREIGN PATENT DOCUMENTS 1480351 7/1977 United Kingdom ..... 148/159

*Primary Examiner*—R. Dean

*Attorney, Agent, or Firm*—Dennison, Dennison, Meserole and Pollack

[57] ABSTRACT

A process for the thermal treatment of a relatively thick product made of a copper-containing aluminum alloy of the 7000 series, the invention involving a solution heat treatment, quenching and tempering in three steps:

(1) preliminary tempering at between 100° and 150° C. for five minutes to 24 hours;

(2) intermediate tempering; and, (3) final tempering for 2 to 48 hours at between 100° and 160° C.

The intermediate tempering step comprises a rapid rise in temperature in the zone at 150° to 190° C. followed by an evolution $\theta(t)$ above 190° C. for a period T, such that:

$$R(T) = \frac{10^{10}}{K} \int_{o}^{T} e^{\frac{-13400}{\theta(t)}} dt$$

is between 1 and 4, K=1.5 except for certain alloys where K=3. T and t are expressed in seconds, $\theta(t)$ is expressed in °K. and is between 463° and 523° K. The present process provides increased mechanical strength to the product as well as a high resistance to stress corrosion.

10 Claims, 4 Drawing Figures

PROCESS FOR THE THERMAL TREATMENT OF THICK PRODUCTS MADE OF COPPER-CONTAINING ALUMINUM ALLOYS OF THE 7000 SERIES

BACKGROUND AND SUMMARY OF THE INVENTION

The present invention relates to a process for the thermal treatment of high strength aluminum alloys of the Al-Zn-Mg-Cu type, such alloys typically being referred to as the 7000 Series and which contain more than 0.05% by weight of copper. The process is particularly useful for treatment of thick products, that is, products which have been wrought by rolling, forging, extrusion, die stamping, etc., and including articles such as bars, billets, sheet billets, thick sheets and other articles having at least one part which is thicker than 15 mm. The conventional treatments for hardening alloys of this type comprise the following sequential steps:

(1) solution heat treatment;

(2) quenching; and (3) tempering possibly with cold plastic deformation of 1 to 5% between the second and third steps for stress-relieving the products in the crude state of quenching. This plastic deformation is generally obtained by controlled traction of rolled or extruded flat products (known also as the TXX51 state) or compression of forged or die-stamped products (known as the TXX52 state). The tempering treatment leading to the highest mechanical tensile characteristics generally involves increasing the temperature to below 140° C., keeping the temperature isothermal and cooling. Such a state is generally known as T6, T651 or T652 depending upon the nature of the plastic deformation after the quenching treatment and is not generally utilized for thick products since poor resistance to stress corrosion is usually encountered in the short transverse direction and to exfoliant corrosion.

The conventional treatment for tempering thick products generally involves a first isothermal step at a temperature below 140° C. followed by a second isothermal step at a temperature above 150° C. and then cooling, each step often being preceded by a slow rise in temperature. It is intended to impart a high resistance to stress corrosion in the short transverse direction, but results in a very substantial reduction in mechanical characteristics with respect to the T6 or T651/T652 state. This state is known by the skilled artisan as the T73 (or T7351, T7352, depending upon the nature of the cold working after quenching) for the 7075, 7175 and 7475 alloys and T736 (or T73651, T73652) for the 7050 alloy. In the conventional treatment a tempering step is intended to impart to rolled products made of 7075 (or 7175, 7475) alloy mechanical tensile characteristics and a resistance to stress corrosion which fall between those of the T6 (or T651) states and T73 (or T7351) states with a high resistance to exfoliating corrosion. This tempering treatment is similar to the T73 (or T7351) tempering treatment, but the periods of treatment are generally shorter. This state is known as T76 (or T7651) by the skilled artisan and is applied in particular to thin or medium sheets.

Resistance to stress corrosion is generally evaluated on samples which have been cut out in the short transverse direction by means of alternate immersion and emersion tests (10 minutes–50 minutes) in a reagent containing 3.5% NaCl in accordance with American Standard ASTM G44-75 (Standard Recommended Practice for Alternate Immersion Stress corrosion Testing in 3.5% sodium chloride solution). The resistance to exfoliating corrosion is evaluated by the EXCO test in accordance with American Standard ASTM G34-72 (Standard Method of test for Exfoliation corrosion Susceptibility in 7XXX Series Copper containing Aluminum Alloys). However, it is possible to simultaneously obtain these two properties which are apparently contradictory (high mechanical characteristics and high resistance to stress corrosion) if a tempering step comprises the following treatment made:

(3a) pre-tempering in the zone from 100° to 150° C. for a period lasting from 5 minutes to 24 hours;

(3b) intermediate tempering at a higher temperature; and, (3c) final tempering for 2 to 48 hours at between 100° and 160° C.

A treatment of this type is described in French Pat. No. 2,249,176 and comprises a short period of intermediate isothermal tempering performed in practice by immersing very small products (cross-section of 1 $cm^2$) in a metallic bath such as Wood's metal. Now it is known that the immersion of aluminum alloys in a medium of this type can lead to very severe intergranular brittleness of the alloys. Moreover, the heating method employed can rarely be considered adequate in view of the difficulties in employing it due, in particular, to the high density of the bath, particularly in the case of large products, for example thick sheets. Finally, although the treatment conditions described are valid for any small articles, they cannot be applied industrially since they do not take into consideration the thickness of the articles. Now it is obvious that the real thermal cycle undergone by the article will be very different, depending upon the thickness of the article.

It is therefore an object of the invention to provide a thermal treatment process for relatively thick products formed of copper-containing aluminum alloys to improve the mechanical strength and stress corrosion resistance thereof.

Further objects and advantages will become more readily apparent in light of the following detailed description of the preferred embodiments.

DESCRIPTION OF THE PREFERRED EMBODIMENTS

Figure 1:
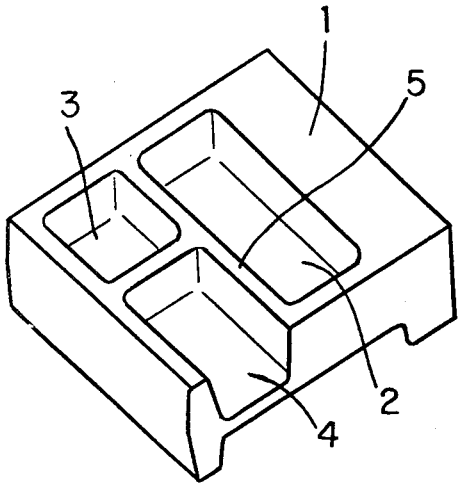
FIG. 1 is a perspective view of a die-stamped article which is to be subjected to thermal treatment according to the invention.

Accordingly, the applicant has found that, in the case of thick articles, products having good mechanical tensile characteristics as well as a high resistance to stress corrosion or exfoliating corrosion are obtained when the residence times are greater than those claimed in French Pat. No. 2,249,176 and that, furthermore, it is by no means necessary to keep the articles at isothermal temperatures. Thus, for example, an intermediate tempering treatment comprising only one rise to a certain temperature, followed immediately by cooling, will give the desired properties.

More generally, the intermediate tempering treatment according to the invention comprises a rise in temperature at a speed higher than 1° C. per minute in the zone of temperatures of between 150° C. and 190° C., followed by an evolution in the temperature of the product ($\theta$) as a function of time (t), $\theta$(t), comprising at least one part at a temperature above 190° C. for a total period T, in such a way that the function:

$$R(T) = \frac{10^{10}}{K} \int_{o}^{T} e^{\frac{-13400}{\theta(t)}} dt$$

falls within the limits defined below.

In this formula:

e is the base of Napierian logarithms;

T is the total period (in seconds) taken from the moment when the temperature of the product reaches 190° C. for the first time in the sense of the rise in the temperature;

$\theta$(t) is the temperature in °K. above 463° K., (that is, 190° C.) of the coldest point of the product and below 523° K. (250° C.), and preferably at 508° K. (235° C.); and, t is the time in seconds.

Steps (3a), (3b) and/or (3c) referred to above can either be separated by return to a temperature below or equal to that of the stage immediately beforehand, in particular to ambient temperature, or can be carried out continuously. It has been observed that the intermediate tempering conditions leading to the optimum properties actually depend upon the existence (or non-existence) of a stress-relieving treatment carried out after quenching (TXX51 or TXX52) and also upon the nature of the alloy.

According to the present invention, the parameter R(T) must be between 1 and 4, and preferably between 1.5 and 3.0, with the following values of K:

| Alloy | Stress-relieved state after quenching | Non-stress-relieved state after quenching |
|---|---|---|
| 7050 | K = 2.25 | K = 3.0 |
| Apart from 7050 | K = 1.05 | K = 1.5 |

Furthermore, contrary to the rules known to the skilled artisan, these rules teaching that long tempering treatments lead to weak mechanical characteristics associated with a high resistance to corrosion, it has been observed according to the invention, that the optimum properties on thick products are obtained after a residence time in the intermediate tempering furnace to $t_m$ (in minutes), the value of which is higher than the maximum value of the period mentioned in French Pat. No. 2,249,176, the disclosure of which is incorporated herein by reference. It has in fact been found according to the invention that thick products treated in furnaces for conventional thermal treatment at a maximum temperature $\theta_M$ for a period which is shorter than the period $t_m$ given by the equation:

$$34 \log t_m = 260 - \theta_M$$

in which $\theta_M$ is expressed in °C. and $t_m$ in minutes (log = decimal logarithm), have a resistance to stress corrosion in the short transverse direction which is much lower than that of the T73 (or T7351, T7352, T736, T76351, T73652 depending upon the products) state while the products treated in accordance with the invention, that is to say, for longer periods, have high strength characteristics as well as a high resistance to corrosion. In fact, the products treated in accordance with the invention have the properties described below.

(1) Mechanical tensile characteristics, in particular in the short transverse direction, are equivalent to those obtained after the conventional hardening treatment known as "T6" (or T651). Their mechanical characteristics tensile stress Rm, and yield stress at 0.2 residual elongation (Rp 0.2) are greater than or equal to 95% of those obtained with "T6" (or T651) carried out on the same alloy, after 24 hours at 120° C. for the 7475 alloy.

(2) Stress corrosion resistance after 30 days of tests is greater than that obtained after the T76 (or T7651) treatment. Resistance to stress corrosion in the short transverse direction of the products treated in accordance with the invention in an alternate immersion-emersion test in the reagent 3.5% NaCl satisfies the present T73 or T736 standards governing rolled, forged, die stamped or extruded products of the same alloy (for example, American Standards QQ-A-1250/12E MIL-A-22771C-AMS 4050).

One of the important advantages of the present invention is that once the thermal kinetics of the products during the intermediate tempering treatment are known by any means (for example, with the aid of thermocouples or by experiments on products of given shape which are heated under reproducible conditions), it is possible to control and to stop the said treatment so as to obtain optimum properties from it. The R(T) function may be calculated by any known means optionally in real time. Another advantage of the present invention is that products having more reproducible properties of use can be obtained because the effect of slight differences between the thermal cycles can be eliminated from one treatment to another or from one furnace to another. The products may be treated by any known device for thermal treatment, preferably in furnaces containing liquid baths such as oil baths or salt baths. In the case of thick products whose cross-section is not uniform, it is advisable for the parameter R(T) to be within the limits given above over all parts of the product which have different laws of temperature evolution so as to obtain characteristics and properties which are as uniform as possible.

It has been further observed that upon leaving the intermediate tempering step, the products treated already have satisfactory mechanical tensile characteristics and stress corrosion resistance but have a toughness measured by the critical stress intensity factor in plane deformation (KIC) according to American Standard ASTM E 399-74, which is clearly superior to that obtained with final tempering. It may therefore be of interest not to follow the intermediate tempering treatment according to the invention by final tempering in certain cases. In addition, the Applicant has observed that it is of particular interest to combine with the tempering treatment according to the invention a thermal treatment at elevated temperature such as that described in French Pat. No. 2,278,785 or alternatively, that described in French Pat. No. 2,256,960, the disclosures of which are incorporated hereinto by reference. In the first case, the preliminary thermal treatment (labelled A in the rest of the description) may be carried out at any moment in the manufacturing cycle before quenching but preferably during the solution heat treatment preceding quenching itself. This preliminary thermal treatment involves bringing the product to an intermediate temperature between the melting temperature of the metastable phases ($\theta$p) and the initial melting temperature of the alloy under the conditions of thermal equilibrium ($\theta_s$:solidus). The treatment must be of sufficient duration to reabsorb the liquid phases which appeared in the first moments of the treatment. This solution heat treatment can also be carried out in two steps, for example, in the case of the 7475 alloy, a first step at normal temperature (465° to 488° C.) for a period of between 15 minutes and 4 hours and a second step at high temperature (505° to 535° C.) for 30 minutes to 90 minutes. In the practice of the invention as described, it is necessary for the hydrogen content to be low, i.e., below 0.5 ppm (by weight) and preferably 0.2 or even 0.1 ppm. After the quenching treatment which is generally carried out in cold water, it is particularly advisable to subject the product to a mechanical stress-relieving treatment prior to tempering. Thus, it is possible to obtain on 7075 or 7475 alloys mechanical characteristics, which are superior to those obtained in a conventional manner on the 7050 alloy (which are in turn superior to those obtained in a conventional manner on the 7075 and 7475 alloys), with characteristics of resistance to stress corrosion, of ductility and of toughness which are an improvement over those of the 7050 alloy treated in a conventional manner.

In the second case, the preliminary thermal treatment (labelled B in the rest of the description) may also be carried out at any moment in the manufacturing cycle preceding the quenching operation. It involves bringing the product to a temperature of between $\theta_s$:temperature of the solidus of equilibrium and $\theta_L$:temperature of the liquidus for a period of 0.5 to 12 hours, maintenance of this temperature being followed immediately by a step at a temperature lower than $\theta_s$ prior to cooling. The temperatures $\theta_s$ and $\theta_L$ are characteristic of each type of alloy and can be determined by micrographic means or by thermal analysis. In certain cases, it may be worth covering the entire surface of the product with an insulating coating before the solution heat treatment after the treatment B above, then to quench the product in hot or boiling water after a solution heat treatment. It is very important that the hydrogen content of the product should be below 0.5 ppm (by weight), preferably below 0.2 ppm or even 0.1 ppm at the moment of quenching.

The coating of articles with an insulating coating involves depositing a temporarily adherent layer of insulating refractory product in a known manner such as by means of a brush, pistol, immersion, or other means, such an operation being performed before the solution heat treatment. The insulating coatings are selected for their properties of thermal insulation, of resistance to heat and to thermal impacts, as well as of adhesion to the article at the moment of application, during the solution heat treatment and finally during quenching. Excellent results have been achieved by using, for example, a mixture of suitable proportions of barium sulfate, titanium oxide, sodium silicate and water. These coatings are applied as uniformly as possible over the entire external surface of the articles to be treated. It is usually sufficient to apply a single layer having a thickness, which is not critical, which is of the order of a few tenths of a millimeter to one millimeter in the case of viscous products. Hot or boiling water quenching involves immersing the article in this medium as soon as it leaves the solution heat treatment furnace.

A preferred treatment mode for flat products is as follows:

Treatment "B"+"A" or conventional solution heat treatment plus cold water quenching plus stress relieving by traction plus tempering according to the invention.

A preferred treatment mode for die stamped or forged articles is as follows:

Treatment "B"+coating of an insulating layer plus "A" or conventional solution heat treatment plus hot or boiling water quenching plus tempering according to the invention.

This combination of treatments leads to products having quite exceptional characteristics which cannot be attained with the conventional means of thermal treatment. The products obtained in accordance with the treatment modes described above have very high mechanical tensile characteristics as well as very high resistance to stress corrosion, good isotropy, improved toughness and internal stresses which are even weaker than those obtained by the combination of the same treatments prior to the quenching and tempering of the T73 or T736 type.

The Examples below, which are not limiting of the scope of the invention claimed, allow the invention to be understood better and allow all the advantages of the invention to be illustrated.

EXAMPLE I

Thick 7475 alloy sheets of 75 mm thickness in the T351 state have been treated. Before the quenching treatment, these sheets were subjected to conventional homogenization and solution heat treatment and, after being quenched, were subjected to stress relieving elongation followed by maturing for 5 days at 20° C. and tempering in accordance with the present means (T651 and T7351 state) and according to the invention. The intermediate tempering treatment according to the invention involves immersion in an industrial nitrite-nitrate salt bath preregulated to a temperature of 225° C., followed by water cooling. The core temperature of the sheet treated in accordance with the invention was measured using a thermocouple connected to a recorder which allowed the treatment to be interrupted after a period of 12 minutes in the case of a value R = 1.9. Table I indicates the mechanical tensile characteristics in the short transverse direction halfway through the thickness of the sheets as well as the life span of stress corrosion samples by traction for 30 days of alternate immersion-emersion testing in a 3.5% NaCl reagent under a charge of 300 to 350 MPa (3 samples per state).

TABLE I

| State | Thermal Treatment | Mechanical Characteristics Short transverse direction Rm (MPa) | Rp 0.2 (MPa) | A(%) | Stress corrosion Stress (MPa) | Life (days) |
|---|---|---|---|---|---|---|
| T651 | 24 h at 120° C. | 442 | 525 | 9.5 | 300 | 4,4,6 |
| T7351 | 6 h 105° C. + 24H 158° C. | 372 | 456 | 8.6 | 300 | 30 NR* |
| Invention | 2 h 120° C. + 12 mn (225° C.) (xx) + 16 h max. at 140° C. | 447 | 514 | 7.4 | 300 and 350 | 30 NR* |

*samples not broken in 30 days of tests
(xx) bath temperature.

These results illustrate the excellent performance obtained as a result of the treatment according to the invention both with regard to the mechanical tensile characteristics and to the resistance to stress corrosion.

EXAMPLE II

Prior to quenching treatment, 110 mm thick sheets made of 7475 alloy in the T351 state were subjected either to a conventional treatment or to a treatment of the type described above at a temperature of 515° C., followed, after cold water quenching, by the conventional tempering treatment (T7351 state) or by the tempering treatment according to the invention, which comprised an intermediate tempering treatment in a nitrite-nitrate salt bath furnace preregulated to a set temperature of 220° C. (treatment lasted 18 minutes giving a coefficient of R=2.3). Table II shows the values of the mechanical tensile characteristics and of the resistance to stress corrosion evaluated in the short transverse direction in the alternate immersion-emersion test lasting 30 days in 3.5% NaCl reagent. Comparison of the values obtained after tempering according to the invention and after conventional treatments shows the increase in the mechanical tensile characteristics and in the resistance to stress corrosion achieved by combining treatment A with the tempering according to the invention.

TABLE II

| Alloy | Treatment before quenching | Tempering | Mechanical Characteristics Rm (MPa) | Rp 0.2 (MPa) | A % | Stress Corrosion Stress (MPa) | Life span (days) |
|---|---|---|---|---|---|---|---|
| 7475 | Conventional | T7351-6h at 105° C. + 24h at 158° C. | 441 | 348 | 8.1 | 280 | 30 NR* |
| | Treatment A | T7351 6h at 105° C. + 24h at 158° C. | 471 | 388 | 7.5 | 300 | 30 NR* |
| | Conventional | Invention 4 h at 120° C. + 18 mn at 220° C. (x) + 48 h 120° C. | 483 | 409 | 6.8 | 320 | 30 NR* |
| | Treatment A | Invention 4 h at 120° C. + 18 mn at 220° C. (x) + 48 h 120° C. | 522 | 455 | 6.2 | 350 | 30 NR* |
| 7050 | Conventional | T73651-24h at 120° C. + 12 h at 177° C. | 482 | 427 | 6.5 | 300 | 30 NR* |

(x) bath temperature
*30 NR Samples not broken in 30 days test

EXAMPLE III

Before the quenching treatment, 150 mm thick forged sheet billets made of 7475 alloy were subjected to a conventional treatment or to a treatment of the B type (temperature above 540° C.). They were coated with the insulating coating described above, were quenched in water at 70° C. then treated by conventional tempering or by a tempering treatment according to the invention with intermediate tempering in a salt bath kept at a set temperature of 220° C. The immersion in the salt bath lasted 19 minutes (R=1.95). The same operation was carried out on a sheet billet of the same thickness made of 7050 alloy which has been subjected, prior to coating, to a conventional treatment, then to coating with an insulating coating, a conventional tempering treatment or a tempering treatment according to the invention (immersion lasting 25 minutes, R=2.1). The mechanical tensile characteristics and the resistance to stress corrosion in the short transverse direction were measured halfway through the thickness as in the preceding Examples. The value of the critical stress intensity factor (KIC) in the short transverse direction is also shown in Table III.

TABLE III

| Alloy | Treatment before quenching | Tempering | Rm (MPa) | Rp0.2 (MPa) | A % | KIC (MPa $\sqrt{m}$) | Stress (MPa) | Life span (days) |
|---|---|---|---|---|---|---|---|---|
| 7475 | Conventional | T7351-6h at 105° C. + 8h at 177° C. | 418 | 377 | 10.1 | 36 | 250 | 30 NR* |
| | Treatment B | T7351-6h at 105° C. + 8h at 177° C. | 449 | 387 | 9.4 | 40 | 300 | 30 NR* |
| | Treatment B | Invention 2h at 120° C. + 19mn (220° C.) (x) + 24h at 120° C. | 495 | 449 | 8.6 | 34.2 | 350 | 30 NR* |
| 7050 | Conventional | T-73651-24h at 120° C. + 12h at 177° C. | 454 | 392 | 6.4 | 26.6 | 250 | 30 NR* |
| | Conventional | Invention 2h at 120° C. + 25 mn (220° C.) (x) + 16h at 140° C. | 487 | 432 | 6.2 | 25.8 | 300 | 30 NR* |
| Standard Conventional Alloy 7050 AMS 4107 | | T736 | 455 | 372 | 3.0 | | 190 | 30 NR* |

(x) = bath temperature
*30 NR Samples not broken in 30 days test

The article shown in FIG. 1 is a die-stamped article made of 7475 alloy and which has a solid heel 1 which is 100 mm thick and recesses 2, 3 and 5, the recess 4 being open at the side and forming a fork. These recesses are edged with ribs 5.

EXAMPLE IV

Four articles such as the article of FIG. 1 were subjected to the following thermal treatments:

TABLE IV

| Article | Treatment before quenching | Coating | Quenching | Tempering |
|---|---|---|---|---|
| Article 1 | Conventional | | Water | T73 (6h at 105° C. + 8h at 177° C.) |
| | (T max = 467° C.) | without | 70° C. | |
| Article 2 | (T max = 467° C.) | with | 70° C. | T73 (6h at 105° C. + 8h at 177° C.) |
| Article 3 | (T max = 467° C.) | with | 70° C. | According to the invention |
| Article 4 | Type B (T>540° C.) | with | water 100° C. | According to the invention |

Figure 2:
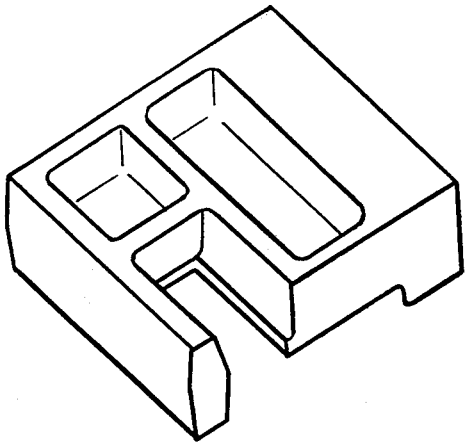
FIG. 2 is a perspective view of the same article after a first machining process performed after treatment.

The tempering treatment according to the invention involved preliminary tempering for two hours at 120° C. followed by immersion of the article in a salt bath brought to a set temperature of 222° C. Some thermocouples placed halfway through the thickness in the recesses 2, 3 and 4, the ribs 5 and the heel 1 allowed the evolution of the temperature in each part of the article to be recorded during the continuous rise in temperature. The article has withdrawn from the salt bath and water-cooled when the values R at all points of the article attained the values claimed by the invention. Immersion in the salt bath at 222° C. lasted a total of 16 minutes and the values of R were comprised between 1.8 (for the heel) and 2.9 (for the recesses). The article was then subjected to a tempering treatment for 48 hours at 120° C. In order to demonstrate the residual stresses in the articles treated, two successive machining processes were performed:

(1) Elimination of the lower gauze forming the base of the fork 4 and measuring of the variation in distance between the two arms of the fork before and after elimination of the gauze (FIG. 2).

Figure 3:
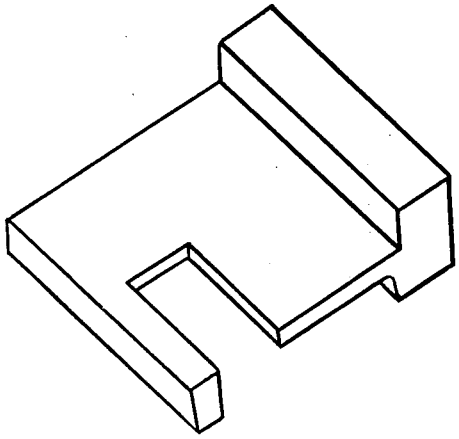
FIG. 3 is a perspective view of the same article after a second machining process; and, FIG. 4 is a perspective view of the article with a key which explains the method of measuring machining deformations.

(2) Complete machining of the upper face of the article so as to cause the disappearance of all the ribs forming the walls of the fork 4 and the boxes forming the upper part of the article (FIG. 3).

Figure 4:
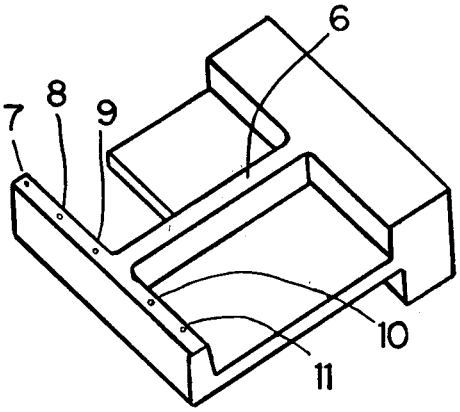

(3) Clamping of the article on the flat part of the heel 1 and measurement of the variations in the dimensions at the points 6, 7, 8, 9, 10, 11 in FIG. 4.

The mechanical tensile characteristics were measured on samples taken in the long transverse direction halfway through the thickness of the article in the heel and the recesses. The resistance to stress corrosion was evaluated in the short transverse direction on samples taken halfway through the thickness of the heel (thick part) by means of alternate immersion/emersion tests in 3.5 NaCl reagent. The stress applied was 320 MPa and the test lasted 30 days. The results are compiled in Table V and show the very substantial reduction in the machining deformations after quenching (and therefore in the residual stresses) obtained by the following combinations of treatment:

(1) Conventional treatment before quenching plus coating plus tepid or hot water quenching plus tempering according to the invention; or, (2) B type treatment before quenching plus coating plus boiling water quenching plus tempering according to the invention.

This reduction in the machining deformations is associated with a compromise in the mechanical tensile characteristics and the resistance to stress corrosion which is greater than that of the prior art.

TABLE V

| Article | Mechanical tensile characteristics (long transverse direction) (MPa) Heel Rm | Heel Rp 0.2 | Heel A % | Recess Rm | Recess Rp 0.2 | Recess A % | Machining Deformation (in mm) Between point arms of the fork | Between point 6 | Stress Corrosion (320 MPa) Avg. Points 7 + 8 + 9 + 10 + 11 | Life span (days) |
|---|---|---|---|---|---|---|---|---|---|---|
| 1 | 492 | 425 | 9.9 | 541 | 479 | 12.9 | 1.75 | 1.30 | 2.55 | 30 NR* |
| 2 | 478 | 408 | 10.3 | 530 | 472 | 12.7 | 0.90 | 0.65 | 1.75 | " |
| 3 | 529 | 475 | 9.4 | 561 | 529 | 12.0 | 0.35 | 0.45 | 1.25 | " |
| 4 | 508 | 436 | 10.2 | 518 | 492 | 12.8 | 0.15 | 0.25 | 0.60 | " |

*30 NR : samples not broken by 30 days of tests

It is to be understood that the invention can be practiced other than as explicitly described above, and is to be limited only by the scope of the appended claims.

What is claimed is:

1. In a process for the thermal treatment of a thick product formed of aluminum alloy of the 7000 series containing at least 0.05% by weight of copper, and having at least one part which has an equivalent thickness of greater than about 15 mm, the thermal treatment being a solution heat treatment including quenching and tempering, the tempering treatment comprising the steps of:

preliminary tempering within a temperature range of between 100° and 150° C. for a period lasting from 5 minutes to 24 hours; and, intermediate tempering at a higher temperature than the temperature at which preliminary tempering occurs, the intermediate tempering step comprising a continuous increase in temperature immediately followed by continuous cooling without an isothermal plateau, characterized in that the intermediate tempering treatment comprises a rise in temperature at a rate above 1° C. per minute in the range of temperatures of between 150° C. and 190° C. followed by an evolution in the temperature of the product as a function of time, or $\theta(t)$, comprising at least a period at a temperature above 190° C. for a total duration T in such a way that the function:

$$R(T) = \frac{10^{10}}{K} \int_{o}^{T} e^{\frac{-13400}{\theta(t)}} dt$$

is between 1 and 4, in which:

e is the base of the Napierian logarithms;

T is the duration (in seconds) taken from the moment when the temperature of the product reaches a temperature of 190° C. for the first time in the rising direction;

$\theta(t)$ is the temperature in °K. of the coldest point of the product above 463° K. (190° C.) and below 523° K. (250° C.) and preferably, below 508° K. (235° C.);

t is the time in seconds; and,

K=3 for the 7050 alloy, and 1.5 for the other alloys of the 7000 series;

the total duration of residence $t_m$ (in minutes) in the intermediate tempering step always being higher than or equal to the value given by the equation:

$$34 \log t_m = 260 - \theta_M$$

in which $\theta_M$ is the maximum temperature attained by the product in °C.

2. A process according to claim 1 and further comprising the step of plastically deforming the product after quenching, characterized in that the values of K is 2.25 for the 7050 alloy and 1.05 for the alloys except for the 7050 alloy.

3. A process according to claim 1 wherein the temperature of the product is equal to or lower than the temperature of the immediately preceding step immediately before and/or after the intermediate tempering treatment and is in particular equal to the ambient temperature.

4. A process according to claim 1, wherein at least two of the tempering stages are carried out continuously.

5. A process according to claim 1, wherein the quenching treatment is preceded at any moment in the process by a thermal treatment carried out at a temperature between the initial melting temperature of the eutectic phases out of equilibrium ($\theta$p) and that of the initial melting of the alloy at equilibrium ($\theta$s=solidus).

6. A process according to claim 1, wherein the quenching treatment is preceded at any moment in the process by a thermal treatment carried out at a temperature between that of the solidus ($\theta$s) and that of the liquidus ($\theta$l), and immediately followed by a step at a temperature below $\theta$s.

7. A process for the treatment of rolled or extruded products according to claim 1, wherein quenching is carried out in cold water and is followed by stress relieving by traction before tempering.

8. A process for the treatment of die-stamped or forged products according to claim 1, wherein the product is coated over its entire surface with an insulating layer before the solution heat treatment, quenching being then carried out in hot or boiling water.

9. A process according to claim 8 wherein the insulating layer is formed by a mixture of barium sulfate, titanium oxide, sodium silicate and water.

10. A process according to claim 1 and further comprising final tempering for 2 to 48 hours at between 100° and 160° C.

* * * * *